US005675842A

United States Patent [19]

Schaefer

[11] Patent Number: 5,675,842

[45] Date of Patent: Oct. 14, 1997

[54] PANTS WITH TWO WAISTBANDS

[75] Inventor: Adolf Schaefer, Agoura Hills, Calif.

[73] Assignee: Authentic Fitness Products, Inc., Van Nuys, Calif.

[21] Appl. No.: 719,458

[22] Filed: Sep. 25, 1996

[51] Int. Cl.[6] ..... A41D 1/06

[52] U.S. Cl. ..... 2/237; 2/221; 2/400

[58] Field of Search ..... 2/237, 227, 228, 2/238, 220, 221, 236, 400, 401, 403, 406

[56] References Cited

U.S. PATENT DOCUMENTS

| | | | |
|---|---|---|---|
| D. 306,090 | 2/1990 | Burneka | D2/10 |
| D. 313,692 | 1/1991 | Karn | D2/42 |
| D. 341,243 | 11/1993 | Costella | D2/11 |
| 1,499,647 | 7/1924 | Emsley | 2/237 |
| 2,034,312 | 3/1936 | Rubin | 2/228 |
| 2,366,031 | 12/1944 | James | 2/236 |
| 2,599,769 | 6/1952 | MacRae et al. | 2/228 |
| 3,414,907 | 12/1968 | Flame | 2/221 |
| 4,164,044 | 8/1979 | Holmes | 2/237 |
| 4,223,408 | 9/1980 | Sullivan | 2/238 |
| 5,050,244 | 9/1991 | Kleinman | 2/227 |
| 5,052,058 | 10/1991 | Mueller | 2/227 |
| 5,136,727 | 8/1992 | Brisco | 2/409 |
| 5,598,586 | 2/1997 | Munjone | 2/237 |

*Primary Examiner*—Gloria Hale
*Attorney, Agent, or Firm*—Amster, Rothstein & Ebenstein

[57] ABSTRACT

A pair of pants with two waistbands includes pants defining a first waistband. A second waistband is made substantially of a material having elastic properties. A connector secures the bottom of the second waistband to the pants and enables movement of the second waistband between a hidden orientation in which it is substantially hidden behind the pants and an exposed orientation wherein it is substantially exposed above the first waistband.

38 Claims, 9 Drawing Sheets

PANTS WITH TWO WAISTBANDS

BACKGROUND OF THE INVENTION

The present invention relates to pants, and more particularly to pants having two waistbands.

It is a current fashion fad for boys to wear their pants with the waistband of their underpants visibly sticking out above the waistband of the pants. Some proponents of this fashion insist on having the bottom of the undergarment waistband substantially spaced above the top of the pants waistband, although the original purpose of the fashion was simply to allow the waistband of the undergarments (presumably bearing the name of the manufacturer) to be visible over the top of the waistband of the pants. The fashion fad is indulged in with a variety of different pants—e.g., long pants, short pants, "active wear", etc.

It would be useful to limit the extent to which the bottom of the undergarment waistband was spaced above the top of the pants waistband. Also it would be desirable to give the wearer the opportunity to decide when and where to display the undergarment waistband so that the wearer could either expose or conceal the undergarment waistband at any given time.

Accordingly, it is an object of the present invention to provide a pair of pants with two waistbands, both of which may be visible when the pants are worn.

Another object is to provide such a pair of pants giving the wearer the option of having the second waistband hidden behind the pants or visible above the first waistband.

A further object is to provide such a pair of pants which, in a preferred embodiment, has a maximum spacing between the first and second waistbands.

A still further object is to provide such a pair of pants which also includes a crotch support.

SUMMARY OF THE INVENTION

It has now been found that the above and related objects of the present invention are obtained in a pair of pants with two waistbands. The pair of pants comprises pants defining a first waistband, the first waistband being made substantially of a first material. A second waistband is made substantially of a second material having elastic properties. Connecting means made substantially of a third material secure the second waistband to the pants.

In a preferred embodiment, the connecting means enables movement of the second waistband between a hidden orientation in which it is substantially hidden behind the pants and an exposed orientation wherein it is at least substantially (and preferably completely) exposed above the first waistband. It is made substantially of a flexible mesh substantially more air-permeable than the first material. It secures a bottom of the second waistband to the pants adjacent a bottom of the first waistband. The connecting means has a pair of opposed edges, one edge being sewn to the pants and the other edge being sewn to the second waistband. It is substantially hidden behind the pants and limits upward movement of the second waistband above the first waistband.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
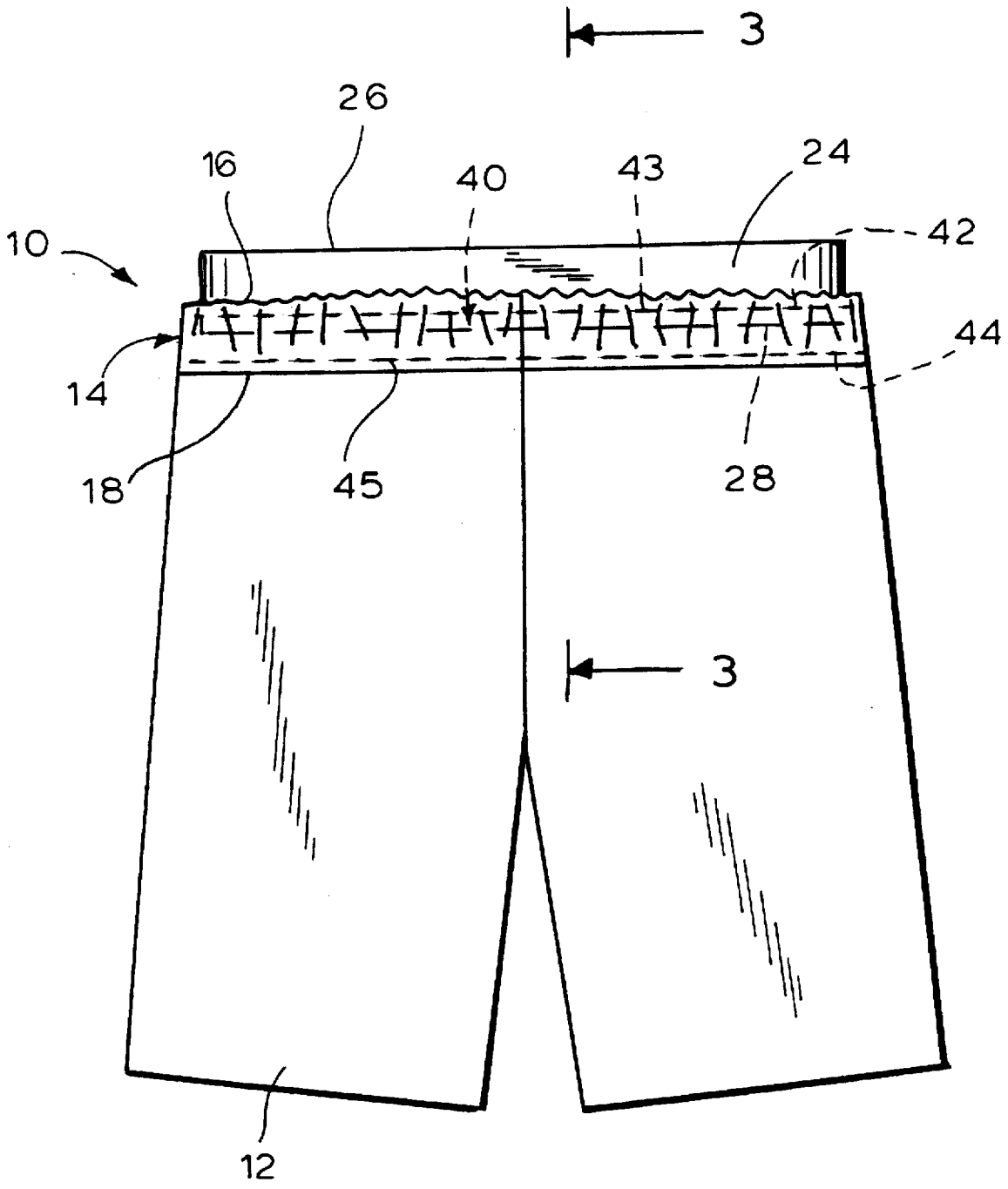
FIG. 1 is a front elevational view of a pair of pants according to the present invention, with the second waistband in the exposed orientation.

Referring now to the drawing, and to FIG. 1 thereof in particular, therein illustrated is a pair of pants according to the present invention, generally designated by the reference numeral 10. In its conventional aspects the pants 10 define a pants body 12 having at the top thereof a first waistband, generally designated 14. The first waistband 14 is made substantially of a first material and has a top 16 and a bottom 18. The pants body 12 may be any one of a number of conventional designs including long pants, short pants, bathing trunks, racing trunks, "active shorts" or the like intended for use as an outer garment (as opposed to "underwear"). The pants body 12, aside from the first waistband 14, may be made of a variety of natural or synthetic materials including cotton, nylon, LYCRA/spandex elastic material, or the like, whether the same or different than the material forming the first waistband 14.

Depending to some degree on the type of pants body 12, the first waistband 14 is elastic and has a height between the top 16 and bottom 18 thereof ranging from about 0.5 to about 3 inches. The first waistband 14 optionally includes a belt (not shown) or belt loop holes (not shown) for supporting a belt about the first waistband 14. The first waistband 14 is optionally decorated with a popular name or logo, such as one associated with a manufacturer, distributor, or sponsor, or a like design or advertisement.

In its novel aspects, the pair of pants 10 additionally includes a second waistband, generally designated 24, made substantially of a second material and having a top 26 and a bottom 28. The second material—i.e., the material forming the second waistband 24—has elastic properties such that it can sustain itself in position on the body of a wearer by snugly gripping the same. Like the first waistband 14, the second waistband has a height from the top 26 to the bottom 28 of about 0.5 to about 3 inches. Typically the second waistband 24 has a greater height than the first waistband 14.

The first and second materials may be the same where it is decided to provide the first waistband 14 as well as the second waistband 24 with elastic properties. While it is possible for the second waistband to bear the same name, logo, design or advertisement as the first waistband, the second waistband may bear the name, logo, design or advertisement of a different manufacturer, distributor or sponsor.

Figure 2:
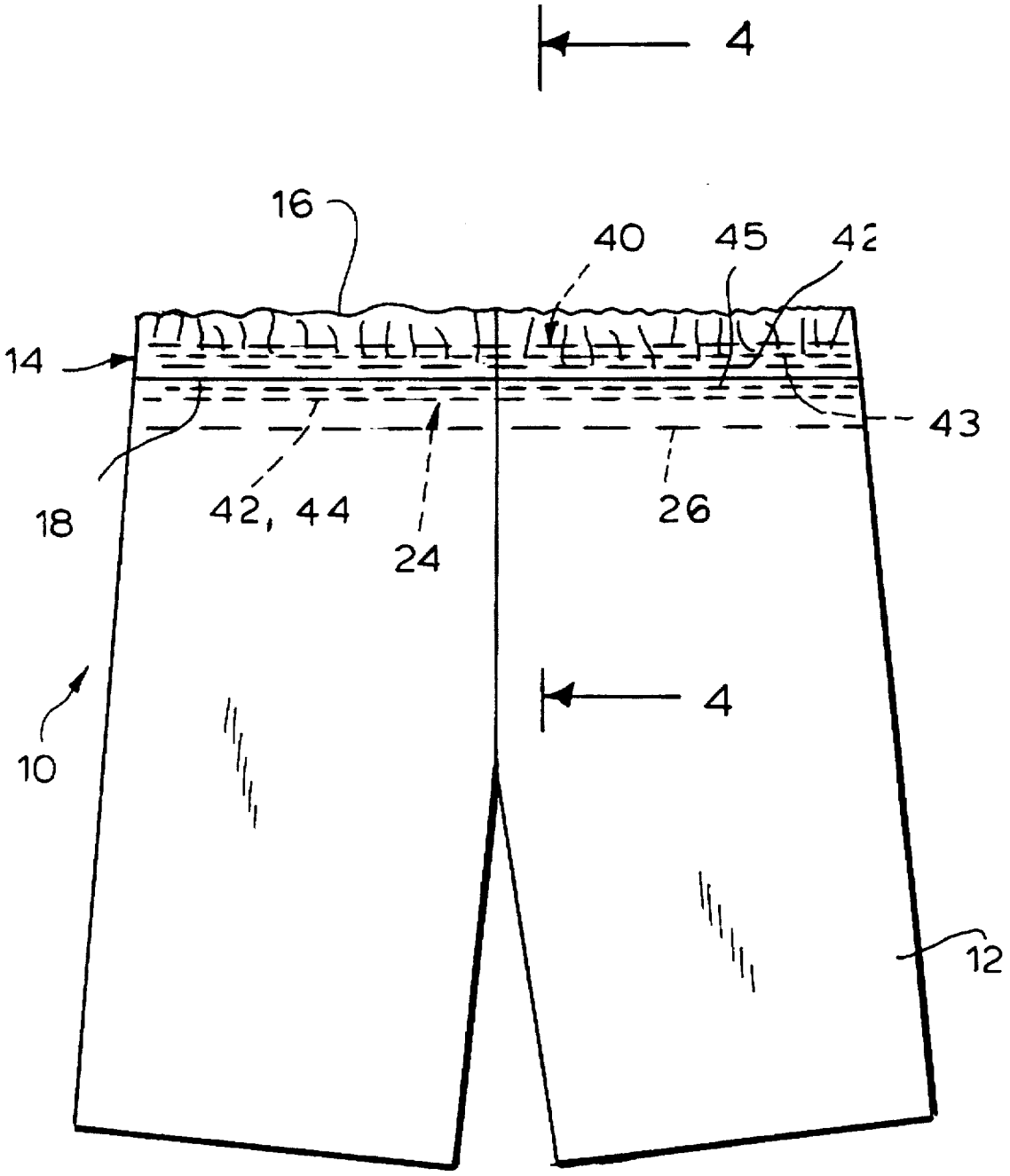
FIG. 2 is a front elevational view thereof with the second waistband in the hidden orientation.
Figure 3:
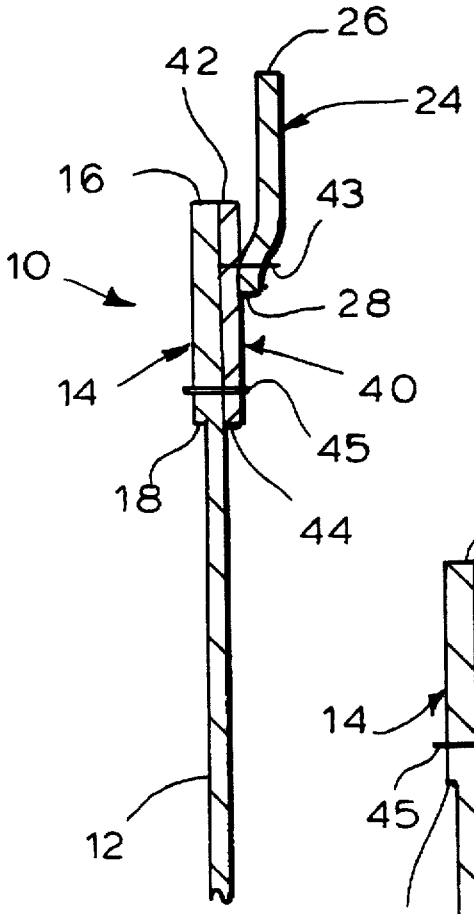
FIG. 3 is a fragmentary sectional view, to an enlarged scale, taken along the line 3—3 of FIG. 1.
Figure 4:
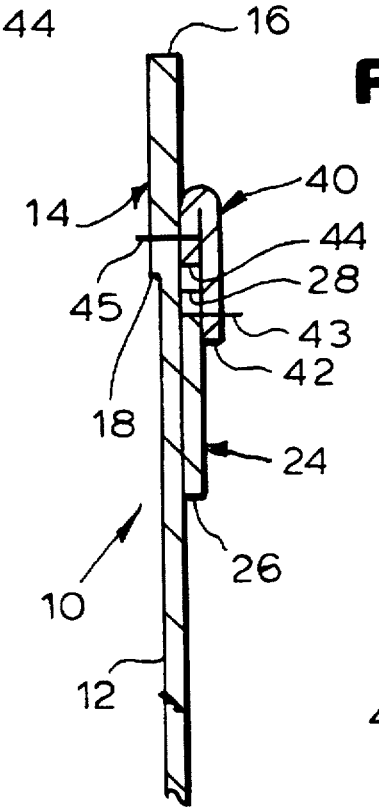
FIG. 4 is a fragmentary sectional view, to an enlarged scale, taken along the line 4—4 of FIG. 2 showing one orientation of the second waistband in the hidden orientation.
Figure 5:
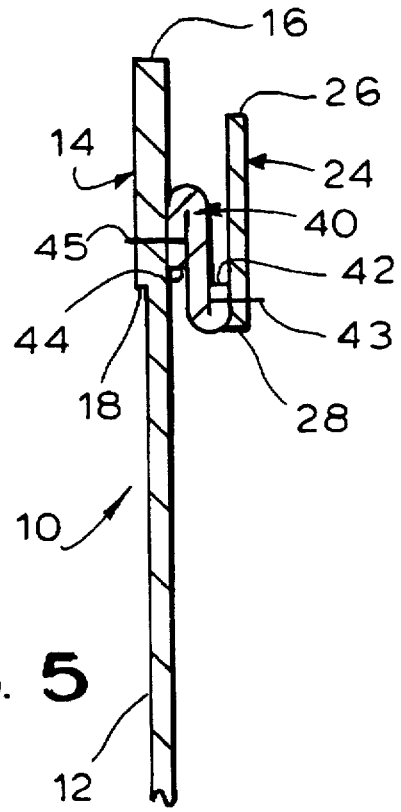
FIG. 5 is a view similar to FIG. 4, to an enlarged scale, showing an alternative orientation of the second waistband in the hidden orientation.

Connecting means, generally designated 40, secures the second waistband 24 to the pants body 12, preferably the bottom of the second waistband 24 to the bottom 18 of the first waistband bottom 18. The connecting means 40 enables movement of the second waistband 24 between a hidden orientation wherein it is substantially, and preferably completely, hidden behind the pants body 12 (as illustrated in FIGS. 2 and 4–5) and an exposed orientation wherein it is substantially, and preferably completely, exposed above the first waistband 14 of the pants body 12 (as illustrated in FIGS. 1 and 3).

The connecting means 40 has a pair of opposed edges 42, 44, one edge 42 being sewn at seam 43 to the second waistband 24 and the other edge 44 being sewn to the pants body 12 at seam 45. The connecting means 40 is substantially, and preferably completely, hidden behind the pants body 12 when the second waistband 24 is in the hidden orientation (as illustrated in FIGS. 2 and 4–5). The connecting means 40 is also substantially, and preferably completely, hidden behind the pants body 12 when the second waistband 24 is in the exposed orientation (as illustrated in FIGS. 1 and 3). Thus, for all intents and purposes, when the pants 10 are worn, the connecting means 40 is not visible, or is nearly not visible, regardless of the orientation of the second waistband 24. The result is a much neater appearance of the pants 10, especially when the second waistband 24 is in the exposed orientation, as the second waistband bottom 28 comes into view just at or immediately above the first waistband top 16.

The length of the connecting means 40 intermediate its top 42 and bottom 44 (actually between seams 43 and 45) limits the upward movement of the second waistband 24 above the first waistband 14. If desired, the wearer, or the parents of the wearer, may take tucks in the length of the connecting means 40 (between seams 43 and 45) to further limit the upward movement of the second waistband 24 above the first waistband 14.

The connecting means 40 is made substantially of a third material which is preferably a flexible open mesh. Such a flexible open mesh is substantially more air-permeable than the first material forming the first waistband 14. Accordingly, when the flexible open mesh is disposed between the first waistband 14 and the wearer's body, the wearer's body is cooler in that region due to the passage of air through the mesh. The third material—that is, the material of the connecting means 40—may be either elastic or non-elastic in nature, as desired for the particular applications for which the pair of pants 10 is intended.

The connecting means 40 has one edge sewn or otherwise secured to the second waistband 24 (preferably adjacent the bottom 28 thereof) and the opposed edge sewn or otherwise secured to the pants body 12 adjacent the first waistband 14 (preferably adjacent the top 16 or, most preferably, adjacent the bottom 18 thereof). When the bottom edge 44 of the connecting means 40 is sewn to the pants body 12 adjacent the first waistband bottom 18, the cooling effect of the third material (intermediate the wearer's body and the first waistband 14) is achieved when the second waistband 24 is in the exposed orientation. On the other hand, when the bottom edge 44 of the connecting means 40 is sewn to the pants body 12 adjacent the first waistband top 16 (not shown), the cooling effect of the third material is achieved when the second waistband 24 is in the hidden orientation. Thus, depending upon exactly where the connecting means bottom edge 44 is secured to the pants body 12, the flexible mesh of the connecting means 40 will be interposed to varying degrees between the wearer's body and the first waistband 14 when the second waistband 24 is in the appropriate orientation.

Referring now in particular to FIGS. 4 and 5, therein illustrated are two different configurations of the second waistband 24 in the hidden orientation. FIG. 4 illustrates the configuration wherein the connecting means 40 has been bent over into an inverted "U" shape so that the second waistband top 26 extends downwardly, typically well below the first waistband bottom 18. Accordingly, some wearers may find the second waistband 24 to be uncomfortably positioned in the hidden configuration illustrated in FIG. 4. By way of contrast, FIG. 5 illustrates the configuration wherein the connecting means 40 assumes an "S" shape with a double curvature: one curvature at its connection with the pants body 12 and one at its connection with the second waistband bottom 28. It will be appreciated that in the FIG. 5 configuration the second waistband top 26 does not extend downwardly as far as in the FIG. 4 configuration and, thus, is less likely to be found uncomfortable by the wearer.

Figure 6:
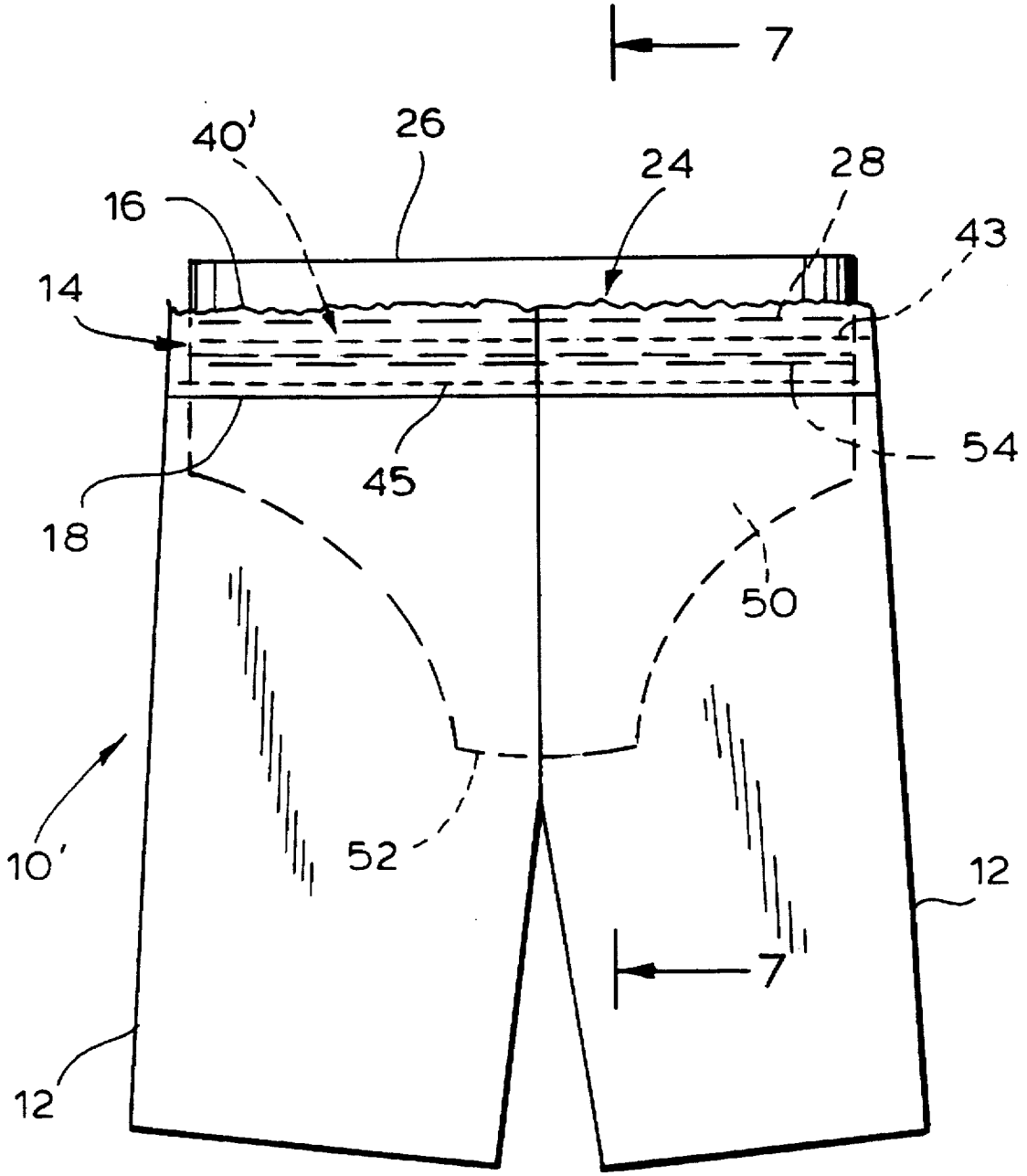
FIG. 6 is a front elevational view of an alternative embodiment of the present invention.
Figure 7:
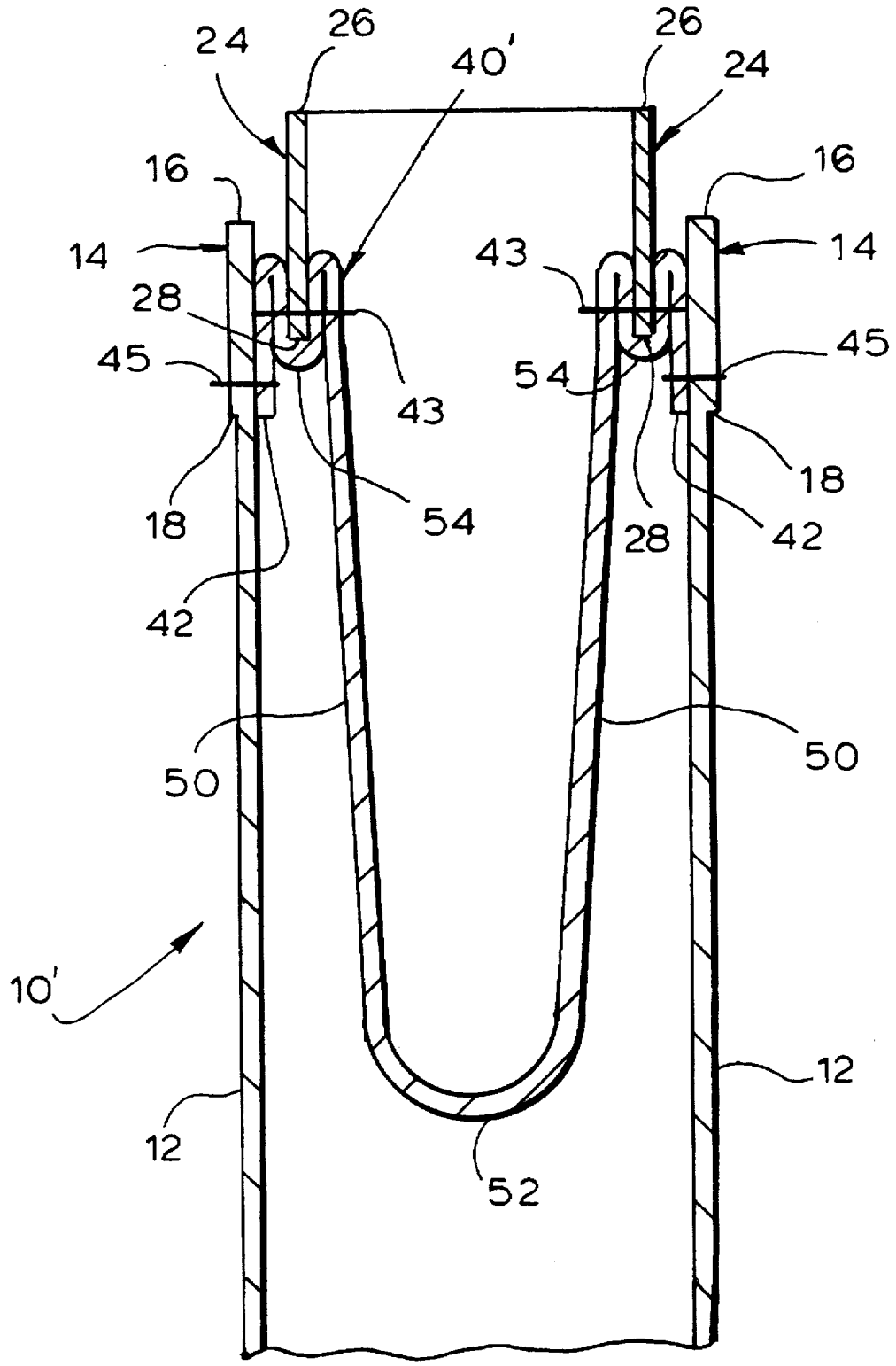
FIG. 7 is a fragmentary sectional view taken along the line 7—7 of FIG. 6.

Referring now to FIGS. 6 and 7, therein illustrated is an alternative embodiment of the present invention, generally designated 10' The embodiment 10' is similar to the embodiment 10 described above and shown in FIGS. 1–2, except that the connecting means 40' additionally includes a crotch support 50 which extends downwardly from the connecting means 40' in the front and back of the pants body 12 and joins together under the crotch of the wearer in a crotch portion 52. The crotch support 50 of connecting means 40' is configured and dimensioned to provide maximum support when the second waistband 24 is in the exposed orientation (so that the crotch portion 52 of the connecting means 40 is riding higher on the wearer), but preferably also to provide some support when the second waistband 24 is in the hidden orientation (so that the crotch portion 52 rides somewhat lower on the body of the wearer). For manufacturing economy, the bottom end 28 of the second waistband 24 may be buried within and sewn to a pocket 54 of the connecting means 40', as illustrated in FIG. 7.

Figure 8:
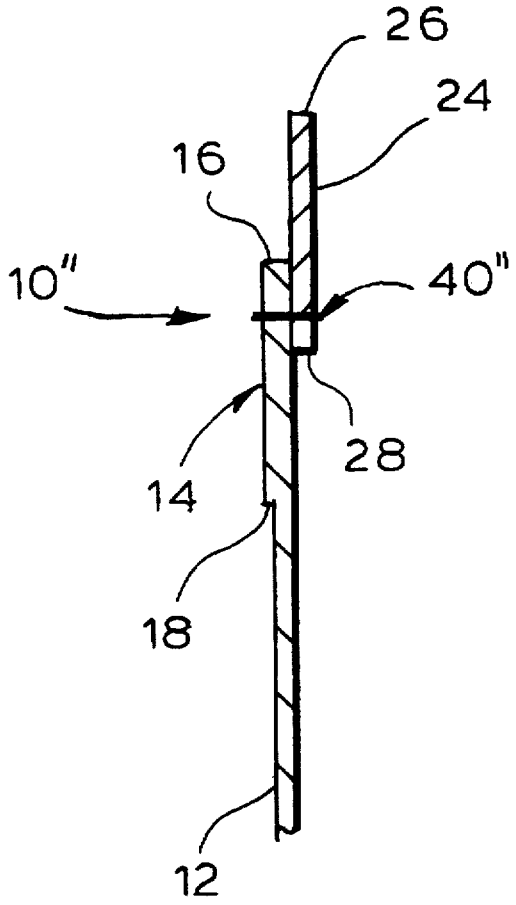
FIGS. 8 and 9 are fragmentary sectional views of a basic embodiment with the second waistband in the exposed and hidden orientations, respectively.
Figure 9:
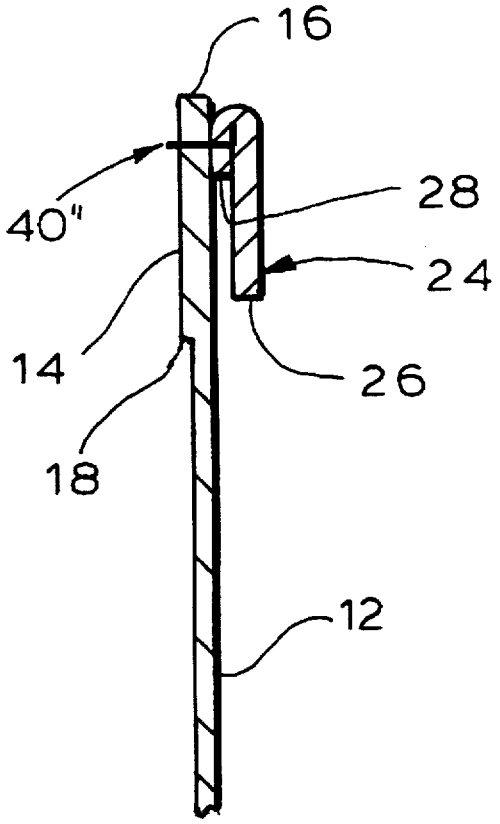

Referring now to FIGS. 8 and 9, therein illustrated is a basic or simplified embodiment of the present invention, generally designated 10". In the basic embodiment 10", the first waistband 14 has a top 16 and a bottom 18, and the second waistband 24 has a top 26 and a bottom 28. However, the connecting means 40" is simply a seam connecting the first and second waistbands 14, 24 rather than a separate piece of material. The second waistband 24 is illustrated in FIG. 8 in its exposed orientation and in its hidden orientation in FIG. 9, an orientation assumed by the second waistband 24 bending over and downwardly adjacent the seam 40". It will be appreciated that in the basic embodiment it is the flexibility of the second waistband 24 which enables movement of the second waistband between the exposed and hidden orientations, not the flexibility of the connecting means 40".

Figure 10:
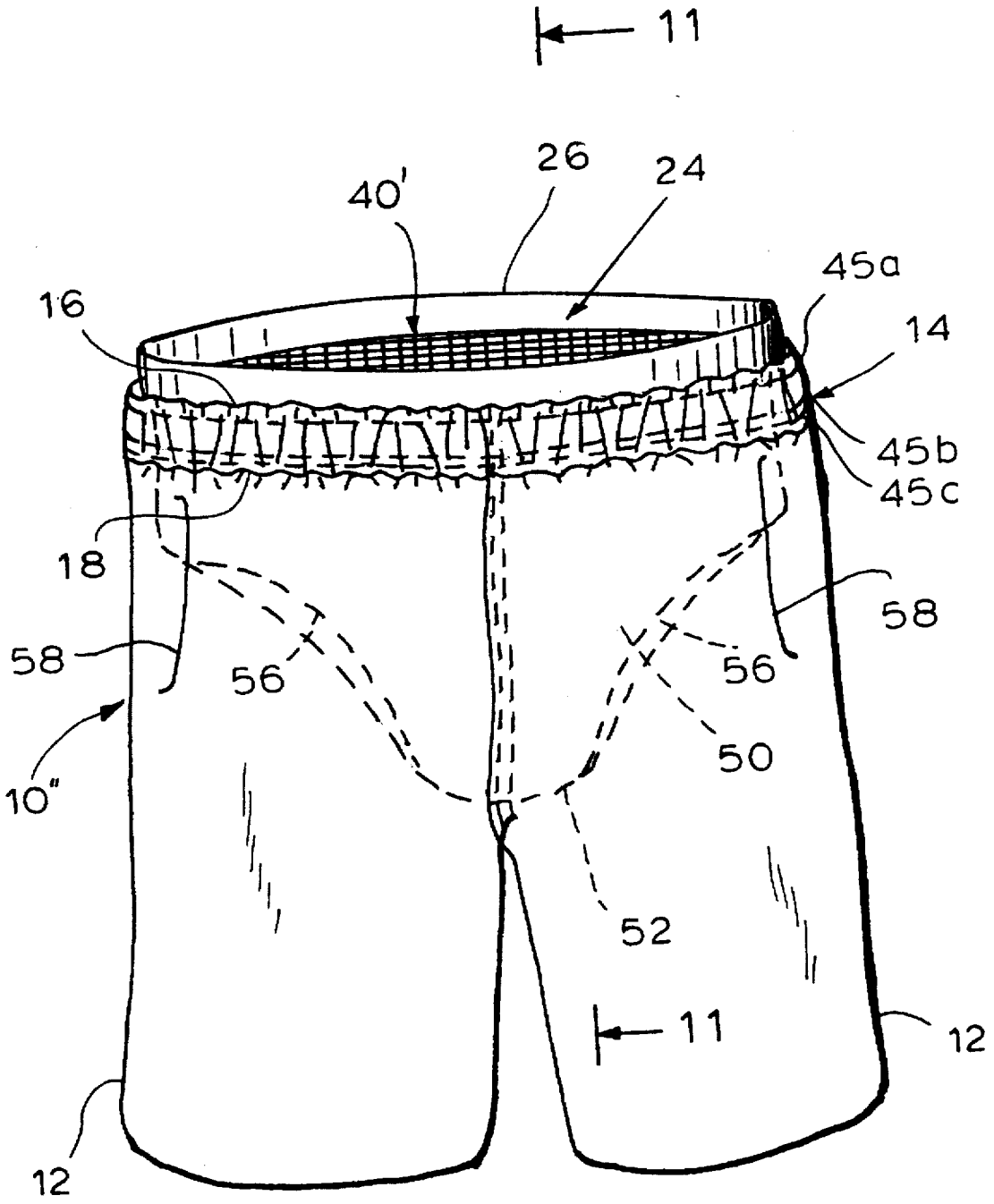
FIG. 10 is a perspective view of the alternative embodiment illustrated in FIG. 6, but showing the construction in greater detail.
Figure 11:
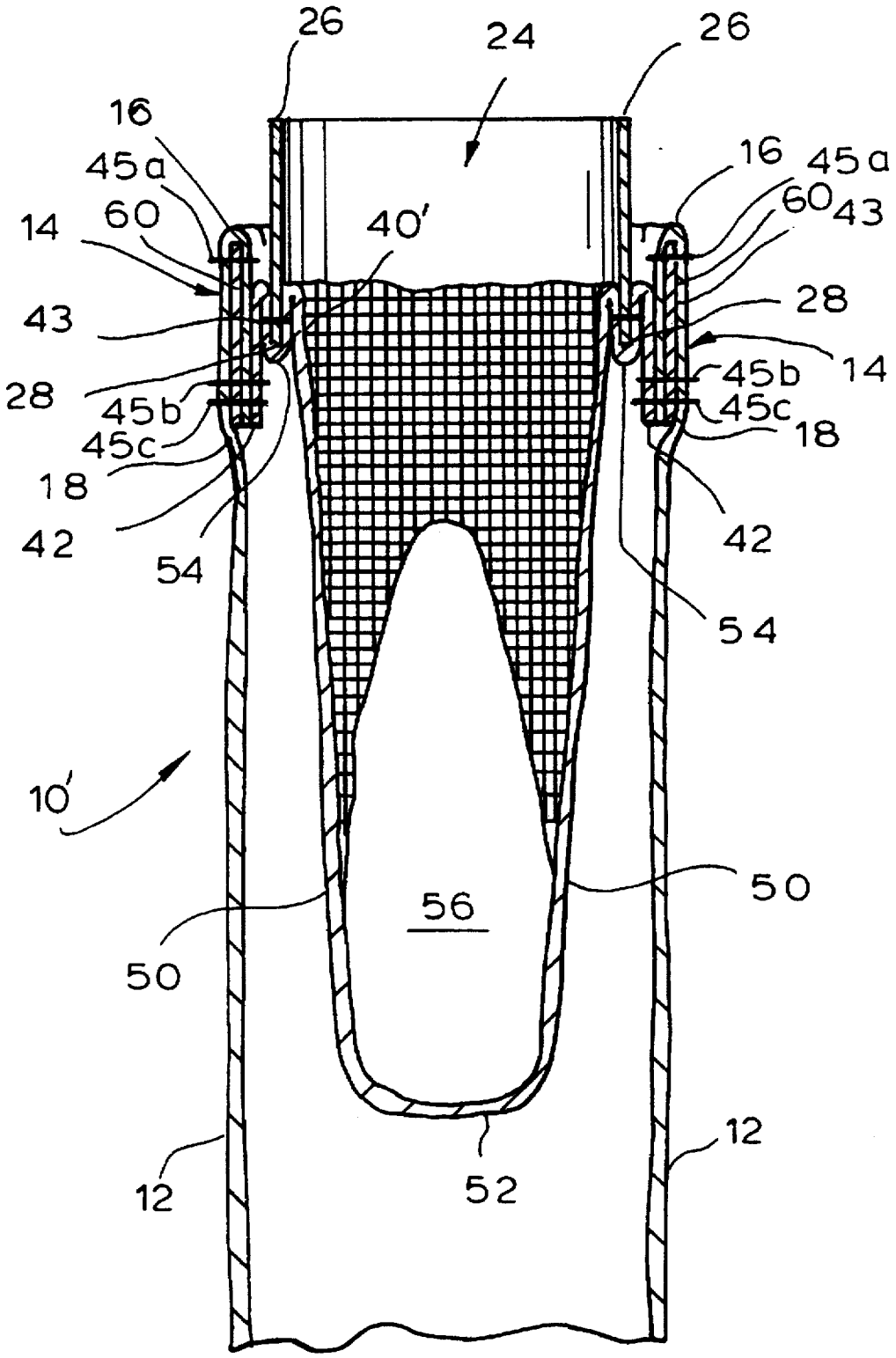
FIG. 11 is a fragmentary sectional view, to an enlarged scale, taken along the line 11—11 of FIG. 10.

Referring now to FIGS. 10 and 11, in these more detailed views of the alternative embodiment illustrated in FIGS. 6 and 7, the connecting means 40' is illustrated as an open mesh of the type frequently used for forming the crotch support of a bathing suit and defines leg openings 56 on either side of the crotch portion 52. Additionally, the pants have a pair of side pockets 58 below the first waistband 14.

The first waistband 14 is formed of an elastic member 60 which has the material of the pants body 12 extending upwardly in front, thereover and downwardly behind the elastic material 60. The elastic material 60 may be the same as that of which the second waistband 24 is formed. The two layers of pants body material and the elastic layer therebetween are maintained in place by not just the representative single stitch or seam 45 illustrated in FIGS. 6 and 7, but by a plurality of stitches or seams. Three stitches are illustrated, stitch 45*a* being adjacent the top of the elastic material 60 and stitches 45*b* and 45*c* being adjacent the bottom of the elastic material 60. Thus the first waistband 14 is generally at least three times the thickness of the pants body 12. The presence of the elastic material 60 within the first waistband 14 causes the illustrated crinkling thereof about the waist of the wearer.

Figure 12:
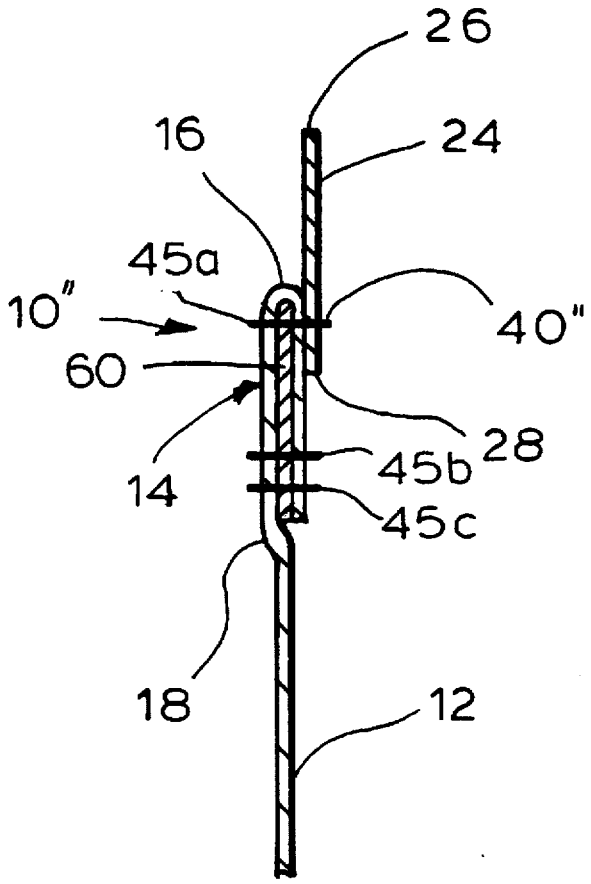
FIGS. 12 and 13 are fragmentary sectional views of the basic embodiment illustrated in FIGS. 8 and 9, but showing the construction in greater detail.
Figure 13:
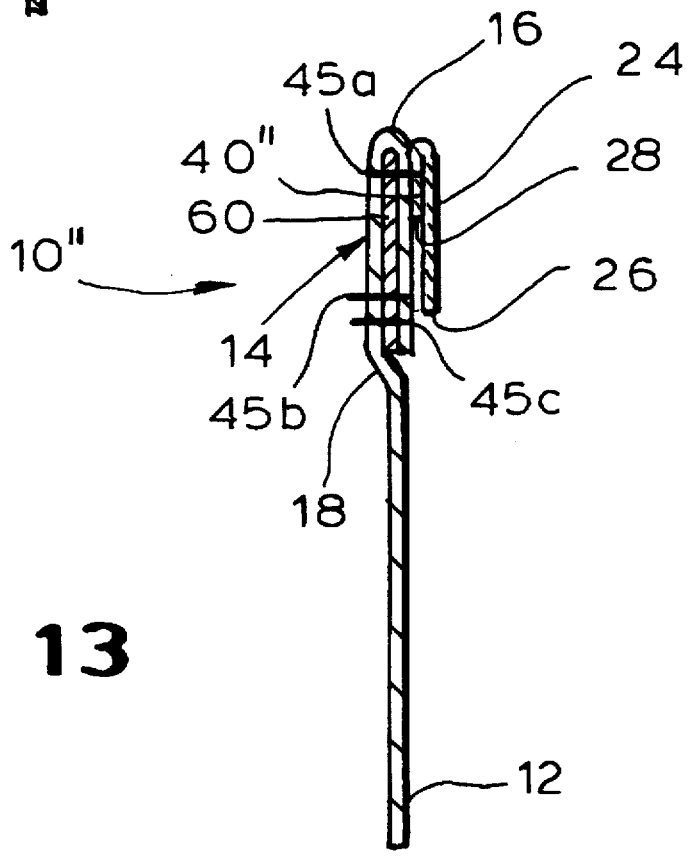

Referring now to FIGS. 12 and 13, these views are similar to FIGS. 8 and 9, but illustrate in greater detail the true nature of the first waistband 14, including the presence of an elastic material 60 therein and the presence of a plurality of stitches or seams 45*a*, 45*b* and 45*c* which maintain the material of the pants body 12 in position about the elastic strip 60. The stitch or seam 45*a* also goes through the second waistband 24 and thereby becomes the connecting means 40" which secures the first and second waistbands 14, 24 together.

The term "substantially," as used herein in "substantially hidden" and "substantially exposed," generally means that about 70% or more is hidden or exposed, respectively.

It will be appreciated that the present invention enables the fashion fad to be indulged in even when worn with garments such as bathing suits which are typically not worn over underpants.

To summarize, the present invention provides a pair of pants with two waistbands, thereby giving the wearer the option of having the second waistband hidden behind the pants or visible above the first waistband. For the sake of decorum, a maximum spacing between the first and second waistbands is provided. In a preferred embodiment, the pants are cooler to wear about the first waistband due to the presence of a mesh intermediate the first waistband and the wearer's body.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A pair of pants with two waistbands comprising:

(A) pants defining a first waistband;

(B) a second waistband; and (C) connecting means for securing said second waistband to said pants.

2. The pants of claim 1 wherein said connecting means enables movement of said second waistband between a hidden orientation in which it is at least partially hidden behind said pants and an exposed orientation wherein it is at least partially exposed above said first waistband.

3. The pants of claim 1 wherein said connecting means enables movement of said second waistband between a hidden orientation in which it is substantially hidden behind said pants and an exposed orientation wherein it is substantially exposed above said first waistband.

4. The pants of claim 1 wherein said second waistband enables movement of said second waistband between a hidden orientation in which it is substantially hidden behind said pants and an exposed orientation wherein it is substantially exposed above said first waistband.

5. The pants of claim 1 wherein said connecting means is substantially more air-permeable than said first waistband.

6. The pants of claim 1 wherein said connecting means secures a bottom of said second waistband to said pants.

7. The pants of claim 1 wherein said connecting means secures said second waistband to said pants adjacent a bottom of said first waistband.

8. The pants of claim 1 wherein said connecting means has a pair of opposed edges, one said edge being sewn to said pants and the other said edge being sewn to said second waistband.

9. The pants of claim 1 wherein said connecting means limits upward movement of said second waistband above said first waistband.

10. The pants of claim 2 wherein said second waistband in said exposed orientation is completely exposed above said first waistband.

11. The pants of claim 2 wherein said second waistband in said hidden orientation is completely hidden behind said pants.

12. The pants of claim 1 wherein said connecting means is substantially hidden behind said pants.

13. The pants of claim 1 wherein said second waistband is elastic.

14. A pair of pants with two waistbands comprising:

(A) pants defining a first waistband;

(B) a second waistband having elastic properties; and (C) connecting means made substantially of a material more air-permeable than said first waistband for securing a bottom of said second waistband to said pants adjacent a bottom of said first waistband.

15. The pants of claim 14 wherein said connecting means enables movement of said second waistband between a hidden orientation in which it is at least partially hidden behind said pants and an exposed orientation wherein it is at least partially exposed above said first waistband.

16. The pants of claim 14 wherein said connecting means enables movement of said second waistband between a hidden orientation in which it is substantially hidden behind said pants and an exposed orientation wherein it is substantially exposed above said first waistband.

17. The pants of claim 14 wherein said second waistband enables movement of said second waistband between a hidden orientation in which it is substantially hidden behind said pants and an exposed orientation wherein it is substantially exposed above said first waistband.

18. The pants of claim 14 wherein said connecting means secures said second waistband to said pants adjacent a bottom of said first waistband.

19. The pants of claim 14 wherein said connecting means has a pair of opposed edges, one said edge being sewn to said pants and the other said edge being sewn to said second waistband.

20. The pants of claim 14 wherein said connecting means limits upward movement of said second waistband above said first waistband.

21. The pants of claim 15 wherein said second waistband in said exposed orientation is completely exposed above said first waistband.

22. The pants of claim 15 wherein said second waistband in said hidden orientation is completely hidden behind said pants.

23. A pair of pants with two waistbands comprising:

(A) pants defining a first waistband;

(B) a second waistband having elastic properties; and (C) connecting means made substantially of a flexible mesh substantially more air-permeable than said first waistband for securing a bottom of said second waistband to said pants adjacent a bottom of said first waistband and enabling movement of said second waistband between a hidden orientation in which it is substantially hidden behind said pants and an exposed orientation wherein it is substantially exposed above said first waistband, said connecting means having a pair of opposed edges, one said edge being sewn to said pants and the other said edge being sewn to said second waistband, said connecting means being substantially hidden behind said pants and limiting upward movement of said second waistband above said first waistband.

24. A pair of pants with two waistbands comprising:

(A) pants defining a first waistband having elastic properties;

(B) a second waistband having elastic properties; and (C) connecting means made substantially of a flexible mesh substantially more air-permeable than said first waistband for securing a bottom of said second waistband to said pants adjacent a bottom of said first waistband and enabling movement of said second waistband between a hidden orientation in which it is substantially hidden behind said pants and an exposed orientation wherein it is substantially exposed above said first waistband; said connecting means having a top edge portion sewn to said pants adjacent a bottom of said first waistband, a middle portion sewn to said second waistband adjacent a bottom thereof, and a bottom portion defining a crotch support; said connecting means being substantially hidden behind said pants and limiting upward movement of said second waistband above said first waistband.

25. A pair of pants with two waistbands comprising:

(A) pants defining a first waistband;

(B) a second waistband; and (C) connecting means for securing said second waistband to said pants, said connecting means having a pair of opposed edges, one said edge being sewn to said pants and the other said edge being sewn to said second waistband.

26. The pants of claim 25 wherein said connecting means enables movement of said second waistband between a hidden orientation in which it is at least partially hidden behind said pants and an exposed orientation wherein it is at least partially exposed above said first waistband.

27. The pants of claim 25 wherein said connecting means enables movement of said second waistband between a hidden orientation in which it is substantially hidden behind said pants and an exposed orientation wherein it is substantially exposed above said first waistband.

28. The pants of claim 25 wherein said second waistband enables movement of said second waistband between a hidden orientation in which it is substantially hidden behind said pants and an exposed orientation wherein it is substantially exposed above said first waistband.

29. The pants of claim 25 wherein said connecting means is a flexible mesh.

30. The pants of claim 25 wherein said connecting means is substantially more air-permeable than said first waistband.

31. The pants of claim 25 wherein said connecting means secures a bottom of said second waistband to said pants.

32. The pants of claim 25 wherein said connecting means secures said second waistband to said pants adjacent a bottom of said first waistband.

33. The pants of claim 25 wherein said connecting means limits upward movement of said second waistband above said first waistband.

34. The pants of claim 26 wherein said second waistband in said exposed orientation is completely exposed above said first waistband.

35. The pants of claim 26 wherein said second waistband in said hidden orientation is completely hidden behind said pants.

36. The pants of claim 25 wherein said connecting means is substantially hidden behind said pants.

37. The pants of claim 25 wherein said second waistband is elastic.

38. A pair of pants with two waistbands comprising:

(A) pants defining a first waistband;

(B) a second waistband; and (C) connecting means for permanently securing said second waistband to said pants at the front and back thereof, said connecting means enabling movement of said second waistband between a hidden orientation in which it is at least partially hidden behind said pants and an exposed orientation wherein it is at least partially exposed above said first waistband.

* * * * *